US006170108B1

(12) United States Patent
Knight

(10) Patent No.: US 6,170,108 B1
(45) Date of Patent: Jan. 9, 2001

(54) ELECTRIC BACK SCRUBBER BRUSH

(76) Inventor: Audrey M. Knight, 1200 Lakeshore Dr., Oakland, CA (US) 94606

( * ) Notice: Under 35 U.S.C. 154(b), the term of this patent shall be extended for 0 days.

(21) Appl. No.: 09/302,751

(22) Filed: Apr. 30, 1999

Related U.S. Application Data

(60) Provisional application No. 60/084,011, filed on May 4, 1998.

(51) Int. Cl.[7] ..... A46B 13/04

(52) U.S. Cl. ..... 15/29; 401/284; 601/17; 601/114

(58) Field of Search ..... 15/24, 29; 401/284, 401/286, 288; 601/17, 112, 114

(56) References Cited

U.S. PATENT DOCUMENTS 4,060,870 * 12/1977 Cannarella ..... 15/24
4,335,481 * 6/1982 Slayman ..... 15/29
4,964,398 * 10/1990 Jones ..... 601/114
5,423,102 * 6/1995 Madison ..... 15/29
5,647,841 * 7/1997 Groenewold ..... 15/29
5,787,539 * 8/1998 Nussbaum ..... 15/29
5,881,418 * 3/1999 Enoch ..... 15/29
5,891,063 * 4/1999 Vigil ..... 601/114

* cited by examiner

*Primary Examiner*—Randall E. Chin
(74) *Attorney, Agent, or Firm*—Goldstein & Canino

(57) ABSTRACT

An electric back brush for providing an invigorating scrub comprising an elongated arm having one end attached to a handle and the other end attached to a head assembly. The length and shape of the elongated arm is selected to permit self-administration to normally hard to reach areas of the body, especially the back. The head assembly includes an electric motor and a brush head attached thereto via a flexible drive shaft for driving the brush head in rotary oscillation while permitting the brush head to pivot freely with respect to the head assembly. The brush head is detachably mounted to the motor so that it can be removed therefrom and fitted with another brush head with different textures whenever desired. A soap reservoir compartment is formed within the elongated arm for storing liquid soap so as to allow the user to selectively dispense soap while scrubbing one's back with the brush head.

7 Claims, 4 Drawing Sheets

ELECTRIC BACK SCRUBBER BRUSH

CROSS REFERENCES AND RELATED SUBJECT MATTER

This invention relates to subject matter contained in provisional patent application Ser. No. 60/084,011, filed in the United States Patent and Trademark Office on May 4, 1998.

BACKGROUND OF THE INVENTION

This invention relates to an electric back scrubbing body brush, in general. More particularly, the invention relates to a back brush which employs an elongated arm, a soap reservoir within the elongated arm, and a rotating brush head coupled to an electric motor, designed for dispensing controlled amounts of liquid soap while providing an invigorating back scrub to hard to reach portions of the user's back.

Various references uncovered in the prior art provide hand-held electric devices for massaging or cleaning the skin of a user. For example, U.S. Pat. No. 3,699,952 to Waters discloses a skin treating appliance having a motor enclosed within a power handle which is arranged to drive a skin treating brush or massaging instrument through an elliptical orbit in a single plane. U.S. Pat. No. 4,027,348 to Flowers discloses another skin treatment appliance for use in the care of facial skin that drives an attachment piece in an orbital path to enhance massaging action to the skin. Likewise, U.S. Pat. No. 3,968,789 to Simoncini discloses an apparatus that moves a skin massaging element in rotary oscillation for massaging the skin.

However, most of these prior art devices have small hand-held casings specifically intended for use on the facial skin or the scalp for cleaning, massaging or applying creams thereto. Therefore, there is still a further need to provide a new and improved electric brush that is specifically designed for the back. Such an electric back brush should employ an electric motor to drive a brush head in rotary oscillation to facilitate a clean and invigorating back scrub. Moreover, such an electric back brush should permit self-administration of a scrub to various portions of the back, including hard-to-reach areas such as between one's shoulder blades.

While these units mentioned above may be suitable for the particular purpose employed, or for general use, they would not be as suitable for the purposes of the present invention as disclosed hereafter.

SUMMARY OF THE INVENTION

It is an object of the invention to provide an electric back brush which is capable of reducing the amount of time necessary to clean the user's body, and yet is capable of providing an enhanced cleaning action to various portions of the back.

It is another object of the invention to provide an electric back brush which employs an electric motor for driving a brush head in a circular path to facilitate a clean and invigorating back scrub.

It is yet another object of the invention to provide an electric back brush with a speed control switch to allow a user to manually select the speed at which the brush head is to be rotated.

It is a further object of the invention to provide an electric back brush which utilizes an elongated arm to permit self-administration of a scrub to normally hard to reach areas of the back, including the hard-to-reach areas such as the upper center of the back.

It is a still further object of the invention to provide an electric back brush to facilitate the efforts of some physically challenged users to independently scrub their backs.

It is a still further object of the invention to provide an electric back brush which has a reservoir within its casing and a soap dispensing mechanism for selectively dispensing controlled amounts of liquid soap.

The invention is an electric back brush for providing a clean and invigorating back scrub comprising an elongated arm having one end attached to a handle and the other end attached to a head assembly. The length and shape of the elongated arm is designed to permit self-administration of the scrubbing action to various portions of the body, including the back. The head assembly includes an electric motor and a brush head attached thereto via a flexible drive shaft for driving the brush head in rotary oscillation while permitting the brush head to pivot freely with respect to the head assembly. The brush head is detachably mounted to the motor so that it can be removed therefrom and fitted with another brush head with different textures whenever desired. A soap reservoir is formed within the elongated arm for storing liquid soap so as to allow the user to selectively dispense soap while scrubbing his or her back with the brush head.

To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
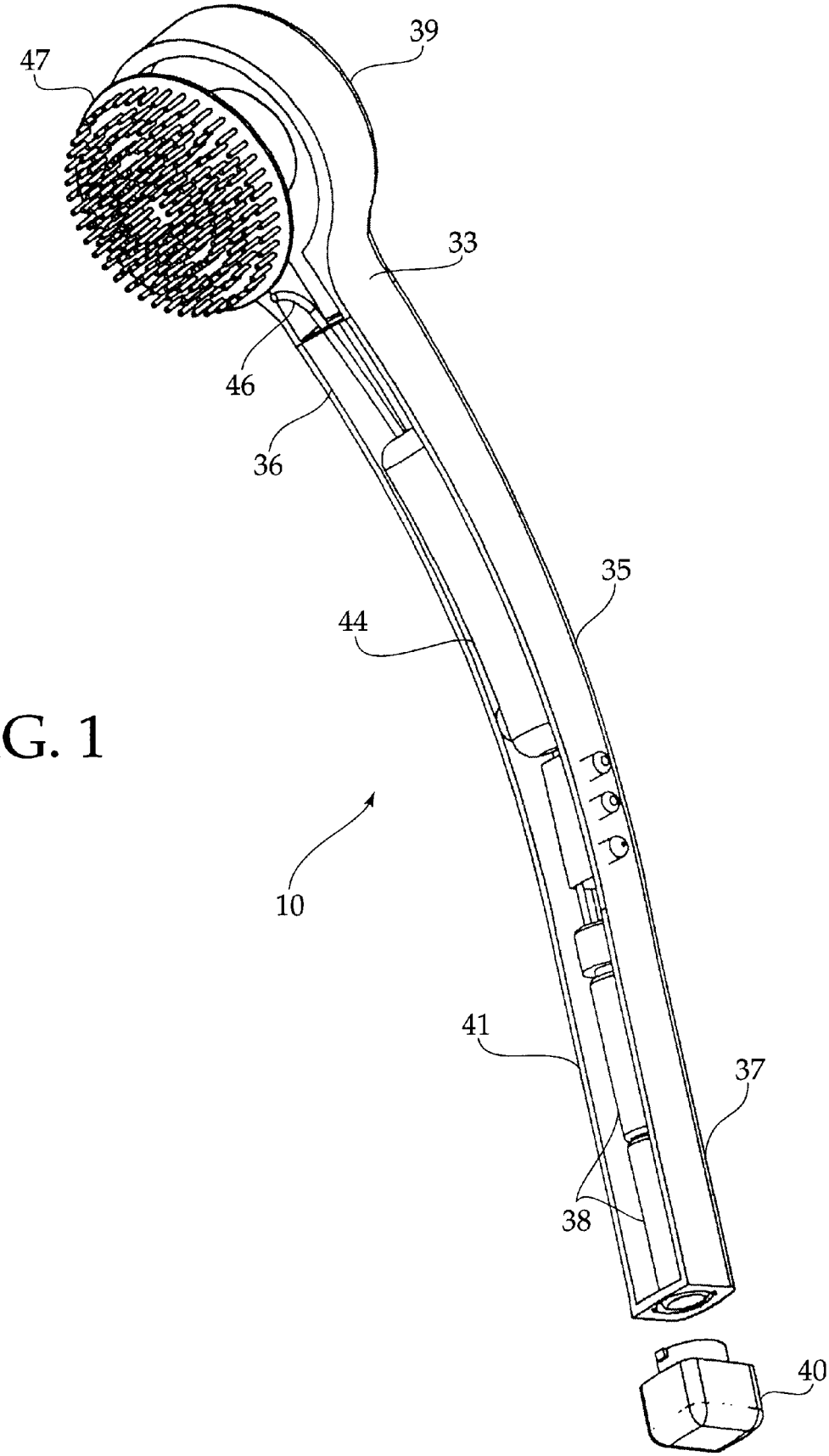
FIG. 1 is a diagrammatic perspective view of a preferred embodiment of an electric back brush in accordance with the principles of the present invention, with a portion of the housing cut away.

FIG. 1 illustrates a preferred embodiment of an electric back brush 10 in accordance with the principles of the present invention. As will be seen in following paragraphs, the electric back brush 10 is designed to selectively dispense liquid soap and clean all portions of a user's back by providing an invigorating back scrub. The electric back brush 10 comprises a casing 33 constructed of molded plastic material. The casing 33 includes an elongated arm 35 having one end attached to a handle 37 and the other end attached to a head assembly 39 and preferably has a watertight construction since the electric back brush 10 will be subjected to water during use. An internal frame 36 provides structural strength to the brush 10. As seen by referring to FIGS. 1 and 2, the elongated arm 35 has a slight curvature adapted to allow a user to hold handle 37 more comfortably during operation of the electric back brush 10. In addition, the length of the elongated arm 35 is selected to permit self-administration to normally hard to reach areas of the body—especially the back.

The head assembly 39 includes an electric motor of any suitable type which is powered by a portable power source 38 contained in a battery compartment 41 located in the handle 37. The portable power source can take the form of batteries or rechargeable batteries. Preferably nickel metal hydride batteries are employed for the power source. The handle 37 has an end cap 40 fully opposite the head assembly 39 for allowing the batteries which make up the power source to be inserted and removed for recharging and/or replacement.

Figure 2:
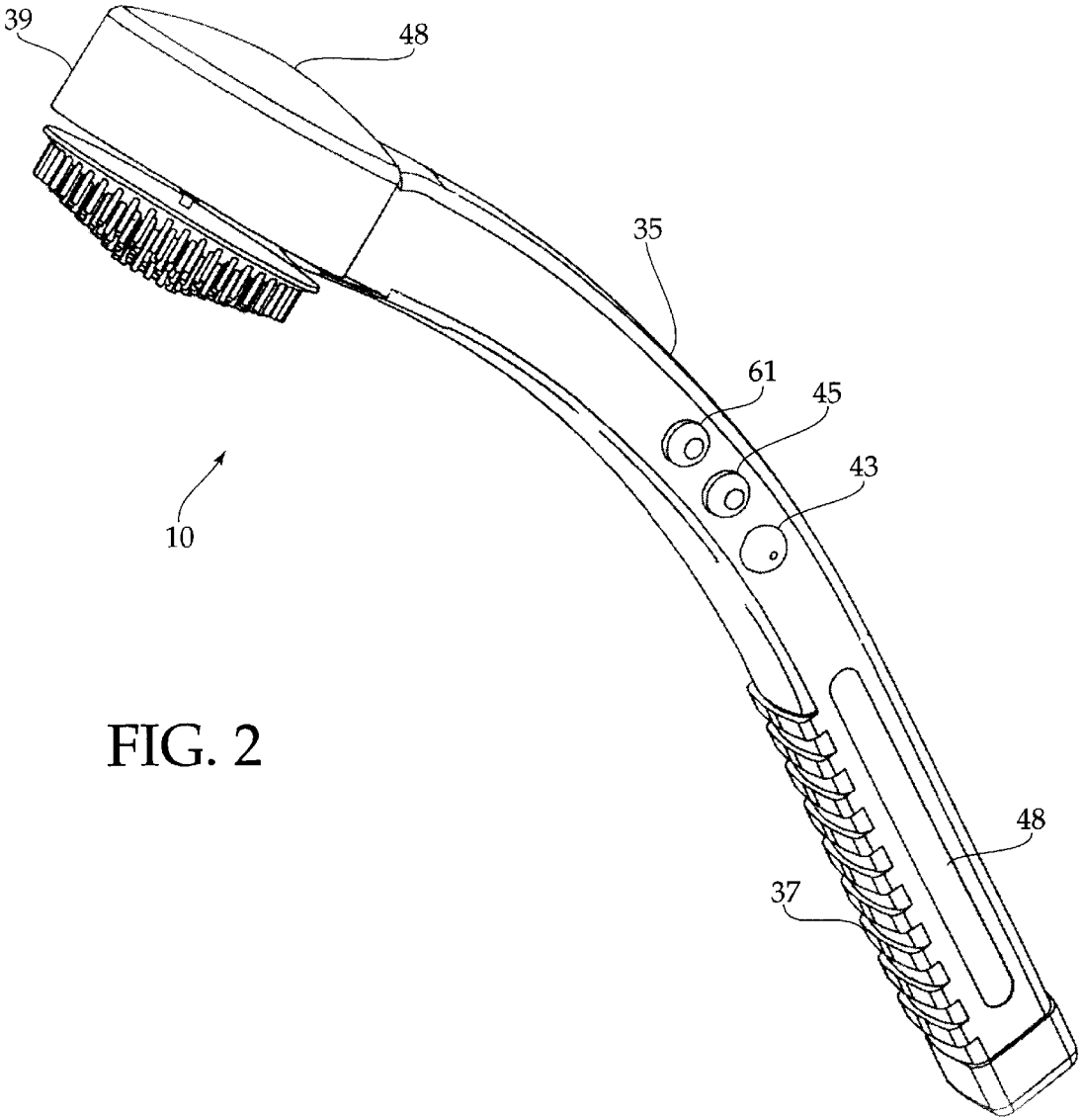
FIG. 2 is a diagrammatic perspective view of the electric back brush of the present invention.

Referring to FIG. 2, a first switch 43 is provided on the casing 35 near the handle 37 for manually operating the motor on and off. The first switch 43 electrically connects the motor and the power source in series whereby the motor is energized by the power source 38 under the control of the first switch 43 to initiate rotation of its drive shaft. The back brush 10 may include a control unit of any suitable type and a second switch 45 operatively coupled thereto so as to allow a user to manually select the speed with which the motor is to be rotated. The control unit of the present invention is preferably of type well known to persons of ordinary skill in the art and forms no part of the present invention. Heat sinks 48 are provided on the head assembly 39 and on the handle 37 for dissipating heat from the motor and from the batteries.

Figure 3:
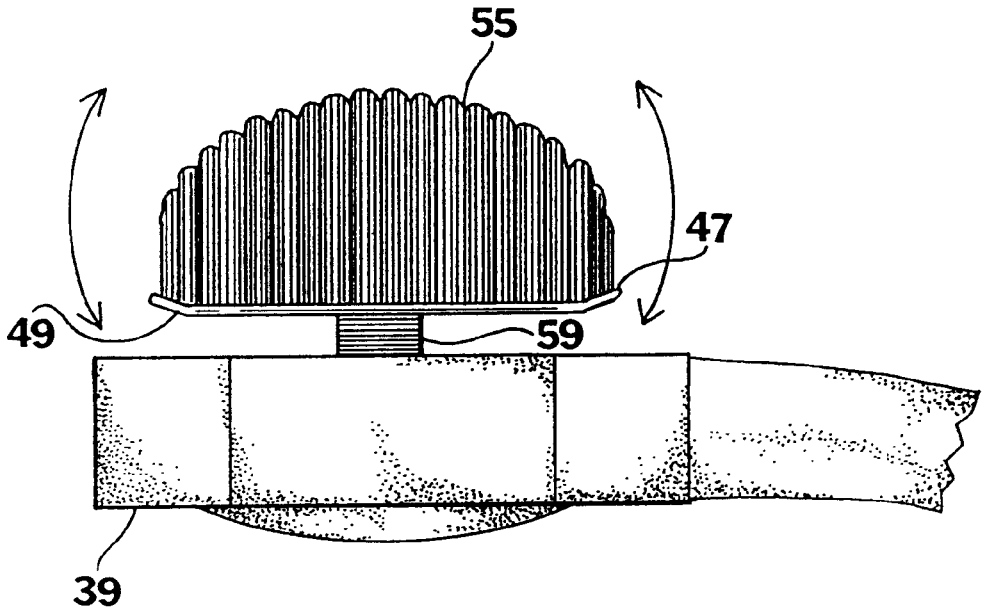
FIG. 3 is a side elevational view of the head assembly of the present invention, illustrating a brush head attached to an electric motor by means of a flexible drive shaft.
Figure 4:
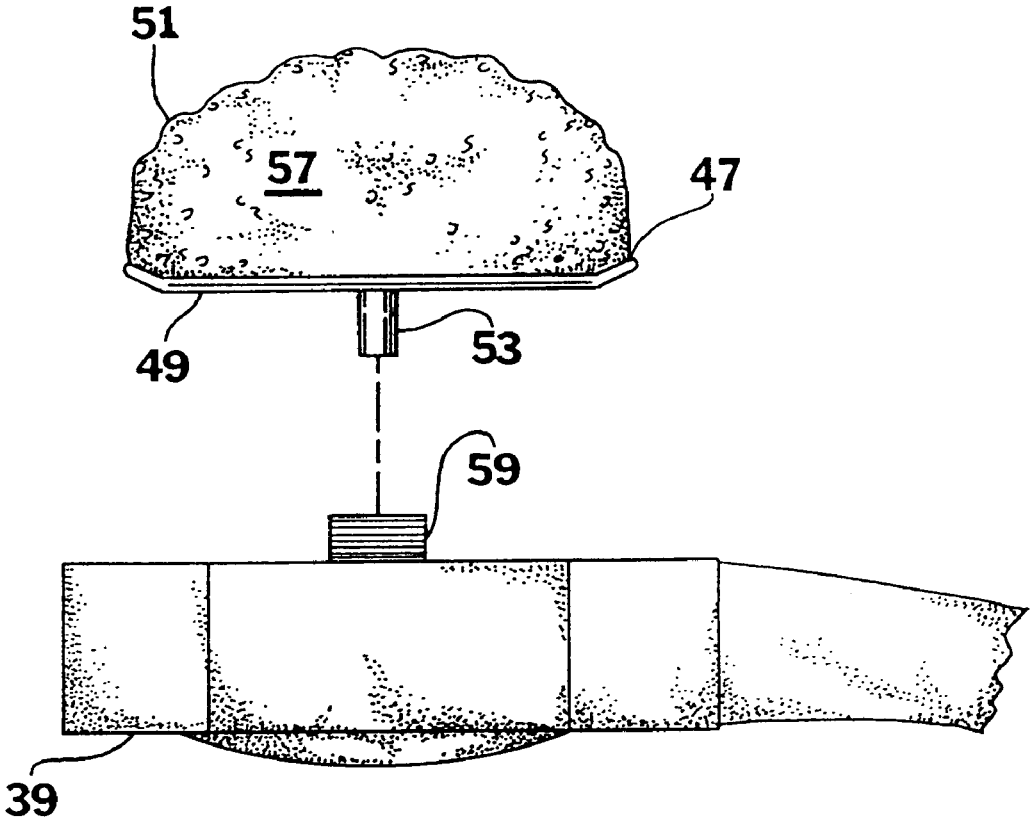
FIG. 4 is a side elevational view of the head assembly of the present invention, illustrating the brush head detached therefrom.

FIG. 4 illustrates an interchangeable brush head 47 including a face plate 49 and a pad 51 sized and shaped to conform to the shape of the face place 49 attached thereto. A nipple 53 is attached to the lower surface of the face plate 49. The brush head 47 is detachably mounted to a drive shaft 59 so that it can be removed therefrom and fitted with another brush head with different texture such as soft, medium, and firm tactile, whenever desired. The pad 51 attached to the brush head 47 can be constructed of a number of different materials. For instance, referring to FIG. 3, one embodiment of the brush head 47 contemplates attaching a bristle pad 55 to the face plate 49. The bristle pad 55 is formed from a plurality of bristles fixedly attached to the face plate 49 and can range from firm, medium, or soft fibers. While in another embodiment of the brush head 47 contemplates attaching a sponge pad 57 to the face plate 49, as shown in FIG. 4.

Turning back to FIG. 3, it will be seen that the brush head 47 is connected to the electric motor by means of a flexible drive shaft 59 for allowing the brush head to pivot freely with respect to the head assembly 39. In this manner, when the brush head 47 is held against the body, the flexible drive shaft 59 assists in forming a better contact between the brush head 47 and the user's back, while the motor drives the brush head 47 in rotary oscillation to provide an invigorating back scrub. The motor preferably has a torque limiting device to promote the comfort of the user.

In keeping with a further aspect of the invention, a soap reservoir compartment 44 is formed within the elongated arm 35 for storing liquid soap. To allow a user to selectively dispense soap, a dispensing valve 46 of any suitable type is provided in the head assembly 39 for regulating flow of soap from the reservoir to the brush head 47. The valve 46 is preferrably located immediately adjacent to the brush head 47 on the casing 35. FIG. 2 illustrates a third switch 61 electrically connected to the valve 46 for selectively dispensing controlled amounts of liquid soap to the brush head 47. When the valve 46 is opened, either the force of gravity pulls the soap from the reservoir through the valve to the brush head 47, or a small pump can be employed. It should be noted that the first 43, second 45, and third 61 switches preferably are all located adjacent the handle 37 to enable the user to hold the handle 37 with one hand and be able to conveniently operate the switches using the same hand.

Many specific details contained in the above description merely illustrate some preferred embodiments and should not be construed as a limitation on the scope of the invention. Many other variations are possible.

What is claimed is:

1. An electric back brush, comprising:

a casing, comprising an elongated arm, a handle, and a head assembly, the handle located fully opposite from the head assembly;

a motor located within the head assembly, the motor having a flexible drive shaft extending from the head assembly;

a brush head, removably attachable to the flexible drive shaft;

a soap reservoir, located within the elongated arm for storing liquid soap; and a dispensing valve, for selectively dispensing the liquid soap from the soap reservoir.

2. The electric back brush as recited in claim 1, wherein the dispensing valve is located immediately adjacent to the brush head.

3. The electric back brush as recited in claim 2, further comprising a power source, located in the handle, for providing power to the motor.

4. The electric back brush as recited in claim 3, wherein the power source comprises batteries, and wherein the handle further comprises a battery compartment, and a selectively removable end cap for providing access to the battery compartment to allow insertion and removal of the batteries.

5. The electric back brush as recited in claim 4, further having a first switch and a second switch, the first switch selectively connecting and disconnecting the motor from the power source, the second switch controlling speed of the motor.

6. The electric back brush as recited in claim 4, further comprising a third switch, for selectively opening and closing the dispensing valve to selectively dispense soap onto the brush head.

7. The electric back brush as recited in claim 6, further comprising heat sinks, one heat sink located on the brush head and another heat sink located adjacent to the battery compartment to dissipate heat from the motor and the batteries.

* * * * *